US007677422B2

(12) United States Patent
Lee

(10) Patent No.: US 7,677,422 B2
(45) Date of Patent: Mar. 16, 2010

(54) SPOUT ASSEMBLY FOR LIQUID CONTAINER

(76) Inventor: Jung Min Lee, #1208 Misung APT. A-dong, 37 Yeouedo-dong, Youngdungpo-gu, Seoul (KR) 150-010

( * ) Notice: Subject to any disclaimer, the term of this patent is extended or adjusted under 35 U.S.C. 154(b) by 967 days.

(21) Appl. No.: 10/535,374

(22) PCT Filed: Nov. 20, 2003

(86) PCT No.: PCT/KR03/02517

§ 371 (c)(1),
(2), (4) Date: May 19, 2005

(87) PCT Pub. No.: WO2004/045977

PCT Pub. Date: Jun. 3, 2004

(65) Prior Publication Data

US 2006/0043056 A1 Mar. 2, 2006

(30) Foreign Application Priority Data

| | | |
|---|---|---|
| Nov. 20, 2002 | (KR) | 10-2002-0074146 |
| Jan. 7, 2003 | (KR) | 10-2003-0001764 |
| Jan. 10, 2003 | (KR) | 10-2003-0002574 |
| Jan. 20, 2003 | (KR) | 10-2003-0004667 |
| Mar. 6, 2003 | (KR) | 10-2003-0015278 |
| Mar. 6, 2003 | (KR) | 10-2003-0015279 |
| Mar. 31, 2003 | (KR) | 10-2003-0020306 |
| Apr. 14, 2003 | (KR) | 10-2003-0024527 |
| May 26, 2003 | (KR) | 10-2003-0035796 |

(51) Int. Cl.
*B65D 47/00* (2006.01)

(52) U.S. Cl. ..... 222/551; 222/92; 222/542; 222/562; 222/568; 222/570

(58) Field of Classification Search ..... 222/92, 222/551, 542, 546, 562–563, 566–567, 569, 222/153.06; 215/252, 256, 344
See application file for complete search history.

(56) References Cited

U.S. PATENT DOCUMENTS

| | | | | |
|---|---|---|---|---|
| 2,950,033 | A * | 8/1960 | Henchert | 222/551 |
| 3,339,773 | A * | 9/1967 | Stull | 215/329 |
| 4,494,682 | A * | 1/1985 | Beckstrom et al. | 222/551 |
| 4,632,282 | A * | 12/1986 | Nagashima | 222/529 |
| 5,105,961 | A * | 4/1992 | Noren et al. | 215/345 |
| 5,110,041 | A * | 5/1992 | Keeler | 229/125.15 |
| 5,501,370 | A * | 3/1996 | Okamura et al. | 222/111 |
| 5,839,627 | A * | 11/1998 | Hicks et al. | 222/541.9 |
| 2002/0030059 | A1 | 3/2002 | Hirota et al. | |

* cited by examiner

*Primary Examiner*—Frederick C. Nicolas
(74) *Attorney, Agent, or Firm*—Westman, Champlin & Kelly, P.A.

(57) ABSTRACT

A spout assembly for a liquid container includes a spouting member formed on an outlet of the container, a closer coupled on the spouting member, a male seal structure formed on the spouting member, and a female seal structure formed on the closer, the female seal structure corresponding to the male seal structure.

12 Claims, 12 Drawing Sheets

SPOUT ASSEMBLY FOR LIQUID CONTAINER

CROSS-REFERENCE TO RELATED APPLICATION

This Application is a Section 371 National Stage Application of International Application No. PCT/KR2003/002517, filed Nov. 20, 2003 and published in English as WO 2004/045977 on Jun. 3, 2004, the contents of which are hereby incorporated by reference in their entirety.

FIELD OF INVENTION

The present invention relates to a spout assembly for a liquid container that that allow liquid material contained in the container to be preserved for a long time by improving a seal state, and more particularly, to a spout assembly that has a female seal structure that is designed to be engaged with a male seal structure formed on a spouting portion of the container, thereby providing a high seal state between the container and the spout assembly.

BACKGROUND OF THE INVENTION

Generally, beverages such as mineral water and juice, or other liquid or gel material such as pharmaceutical agents and detergents are container in a variety of containers, which is then packed, delivered, and sold. A closer is coupled on an opening of the container. In use, a user opens the closer and exhausts the contents. When the content is beverage, the user drinks the content with his/her lip contacting the spouting portion or using a straw.

The container may be a synthetic resin bottle or a pouch container, or a paper container. When the container is the pouch container, a spouting body is attached on the pouch container and the spouting body is closed by a closer.

However, such a conventional spout assembly for the liquid container is designed to depend on only the coupling force between the closer and the opening of the container, sufficient seal force cannot be provided. That is, there may be a leakage even by small external shock.

SUMMARY OF THE INVENTION

Therefore, the present invention has made in an effort to solve the above-described problems of the conventional art.

It is an objective of the present invention to provide a spout assembly for providing a tight seal between a closer and a spouting portion by engaging a male seal member formed on the closer and a female seal member formed on the spouting portion in addition by screw-coupling the closer on the spouting portion.

To achieve the objective, the present invention provides a spout assembly for a liquid container, comprising a spouting member formed on an outlet of the container; a closer coupled on the spouting member; a male seal structure formed on the spouting member; and a female seal structure formed on the closer, the female seal structure corresponding to the male seal structure.

The male seal structure comprises a male seal projection formed on an upper end of a spouting portion of the spouting member, and the female seal structure comprises an insertion groove in which the male seal projection is inserted.

The male seal structure comprises a circumferential elastic seal projection formed on an upper end of a spouting portion or an inner wall defining the spouting portion.

The circumferential elastic seal projection is inclined outward or inward, and the female seal structure comprises a seal wall tightly depressing the circumferential elastic seal projection.

The female seal structure comprises an insertion groove in which the circumferential elastic seal projection is inserted.

The female seat structure comprises a circumferential inclined wall for guiding the circumferential elastic seal projection.

The spout assembly further comprises a tamper-proof connected to the closer, the tamper-proof being provided with elastic projections and the spouting member being provided with hook projections, at least couple of distances between the elastic projections and the hook projections are different from each other so that the elastic projections can contact the hook projection with time differences when opening the closer.

The tamper-proof is further provided with resistance projections and the spouting member is provided with elastic hook projections.

A space is defined above an attaching portion of the spouting member, the attaching portion being attached on the inlet of the container.

A straw is inserted in the spouting portion of the spouting member.

The spouting member comprises a spouting guide member extending downward from an attaching portion that is attached on the inlet of the container.

The spouting member is integrally formed with the container.

The spouting member is attached on the inlet of the container.

The container is formed of a paper pack or a film pouch.

DETAILED DESCRIPTION OF THE PREFERRED EMBODIMENTS

A preferred embodiment of the present invention will be described more in detail hereinafter in conjunction with the accompanying drawings.

Figure 1:
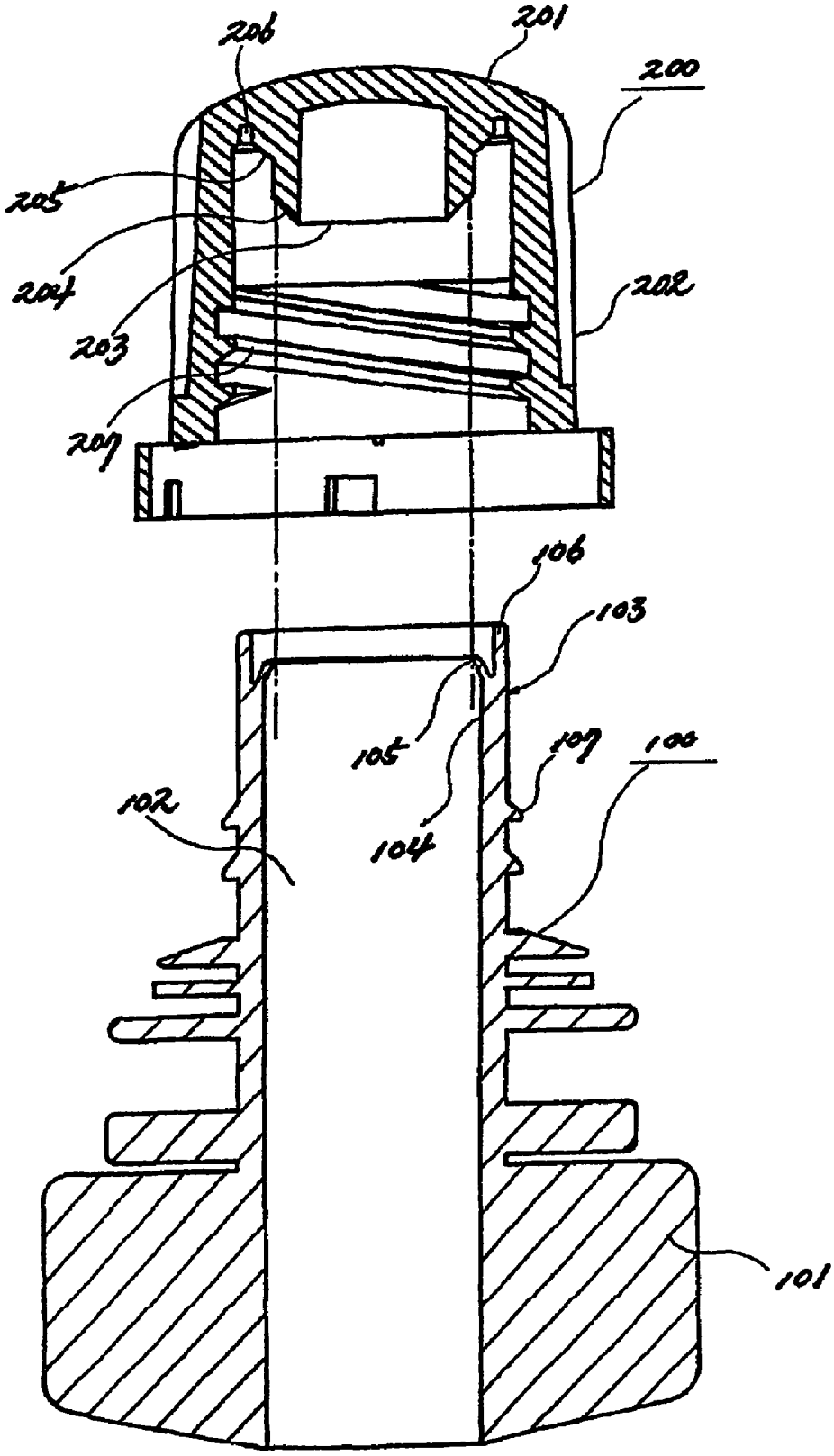
FIG. 1 is a front view of a sectional view of a spout assembly for a liquid container according to the present invention.
Figure 2:
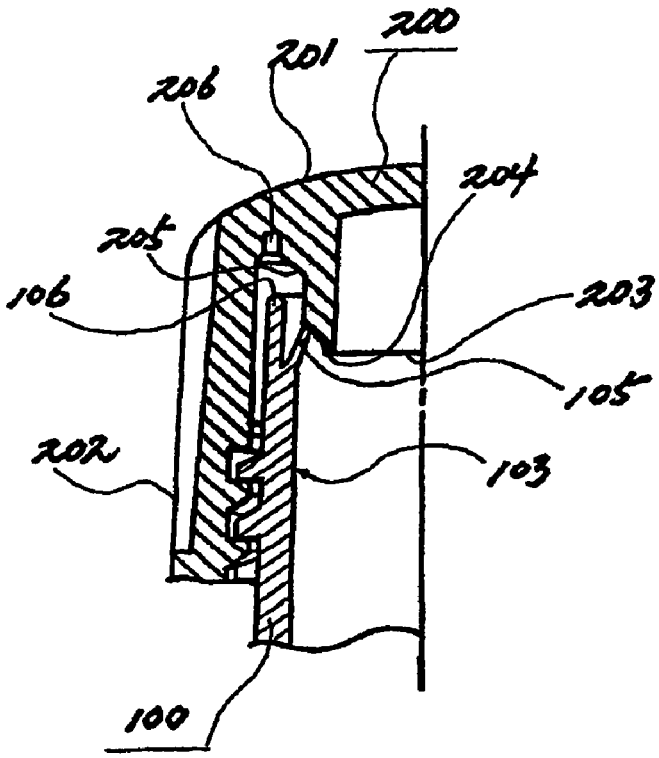
FIGS. 2 and 3 are enlarged sectional views illustrating an assembled state of a spout assembly according to the present invention.
Figure 3:
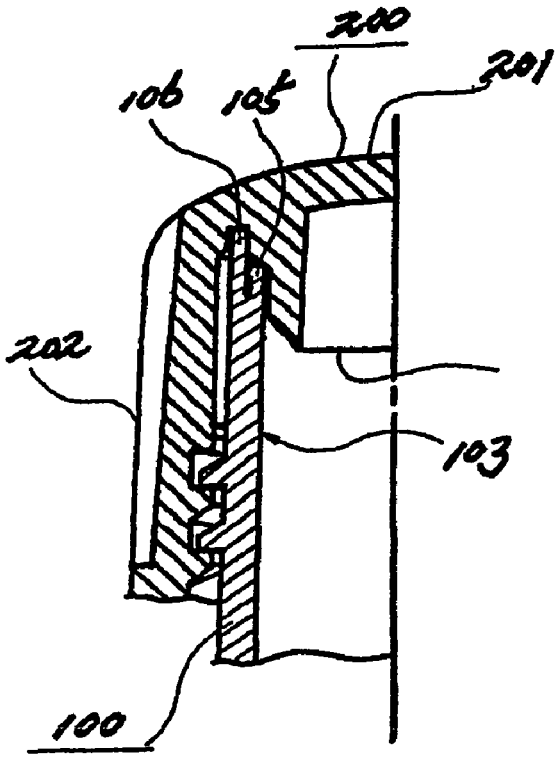

FIGS. 1 to 3 shows a preferred embodiment of the present invention, illustrating a closer is coupled on a spouting portion.

In the drawing, a pouch container or other flexible synthetic resin containers are exampled as a container. A spouting member 100 is associated with the container, and a closer 200 is coupled on the spouting member 100.

The spouting member 100 comprises an attaching portion 101 attached on the container, and a spouting portion 103 extending upward from the attaching portion 101 and provided with a spouting hole 102.

As a feature of the present invention, the spouting portion 103 is provided with male seal structure. The male seal structure comprises a circumferential elastic seal projection 105 formed on an inner circumference of the spouting portion 103. The circumferential elastic seal projection 105 extends upward from the inner circumference of the spouting portion 103, being inclined toward a central axis of the spouting portion 103. An upper end portion of the spouting portion 103 defines a male seal projection 106.

A closer 200 that will be associated with the spouting member 100 is provided with a female seal structure corresponding to the male seal structure. The closer 200 comprises a top portion 210, a side portion 202 extending downward from the top portion 210, and an inner closer 203.

The inner closer 203 is provided with a female seal structure corresponding to the male seal structure of the spouting member 100. The female seal structure comprises a circumferential inclined surface formed on a lower-end outer circumferential surface 204 of the inner closer 203 and a circumferential seal wall 205 defined on the inner closer 203 above the lower-end outer circumferential surface 204 to depress the circumferential elastic seal portion 105 of the spouting member 100. The female seal structure is provided with an insertion groove 206 formed on a bottom of the top portion near the outer circumference of the circumferential seal wall 205. The male seal projection 106 is inserted in the insertion groove 206.

An operation effect of the present invention will be described hereinafter.

In the course of assembling the closer 200 on the spouting portion 103 of the spouting member 100, a thread 107 of the spouting portion 103 is coupled with a thread of the closer 200, and at the same time, the female seal structure of the closer is tightly interlocked with the male seal structure of the spouting member 100.

That is, as shown in FIG. 2, the inclined wall 204 of the inner closer 203 first contacts the circumferential elastic projection 105 of the spouting member 100 and pushes the circumferential elastic projection 105 outward.

From this state, when the closer 200 is further rotated, the inclined wall 204 further pushes the projection 105 outward, whereby the circumferential seal wall 205 depresses the upper end of the projection 105 to provide an enhanced seal. At the same time, the male seal projection 106 is inserted in the insertion groove 206, thereby providing a tight seal (see FIG. 3).

The closer 200 may be assembled o the spouting portion 103 of the spouting member 100 by a one-touch coupling manner instead of the screw-coupling manner.

FIGS. 4 to 11 show a variety of modified examples of the male seal structure.

Figure 4:
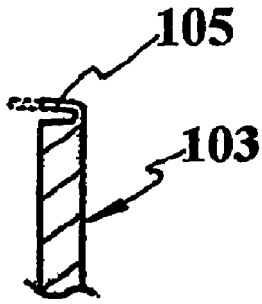
FIGS. 4 to 12 are sectional views illustrating a variety of modified examples of male and female seal structures according to the present invention.
Figure 5:
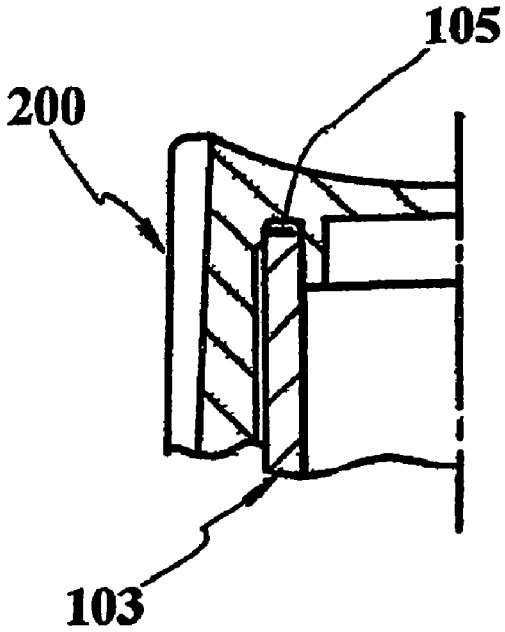

Referring first to FIGS. 4 and 5, the circumferential elastic projection 105 is formed on an upper end of the spouting portion 103 and folded inward or outward. In use, circumferential projection 105 is elastically inserted in an insertion groove of the closure 200.

Figure 6:
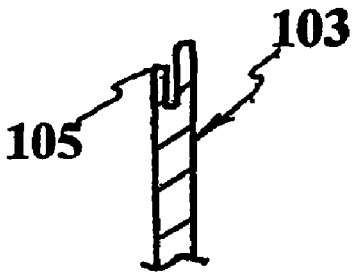
Figure 7:
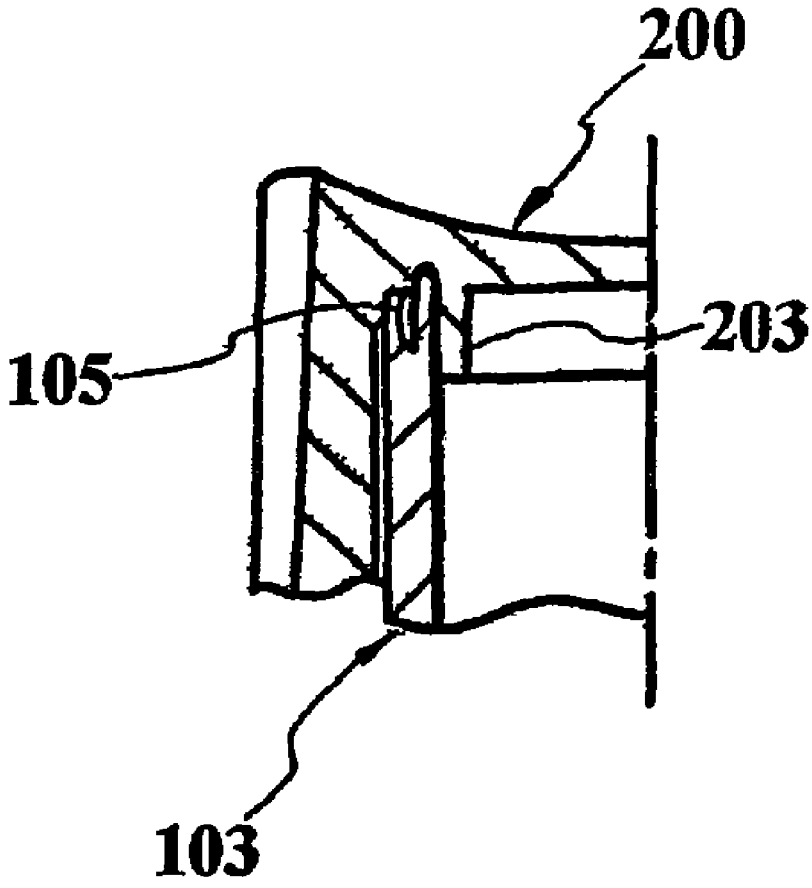

Referring to FIGS. 6 and 7, the circumferential elastic projection 105 is designed to extending upward from an inner wall of the spouting portion 103. In use, the circumferential elastic projection 105 is elastically compressed by an inner wall of the closer or an outer wall of the closer 203, thereby providing a tight seal.

Figure 8:
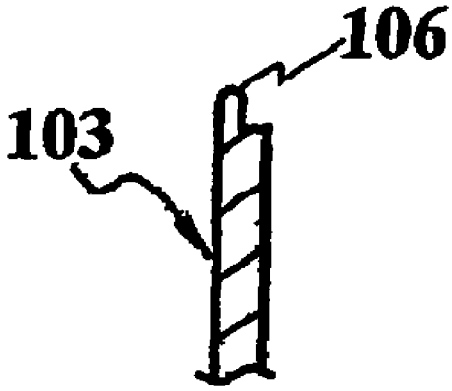
Figure 9:
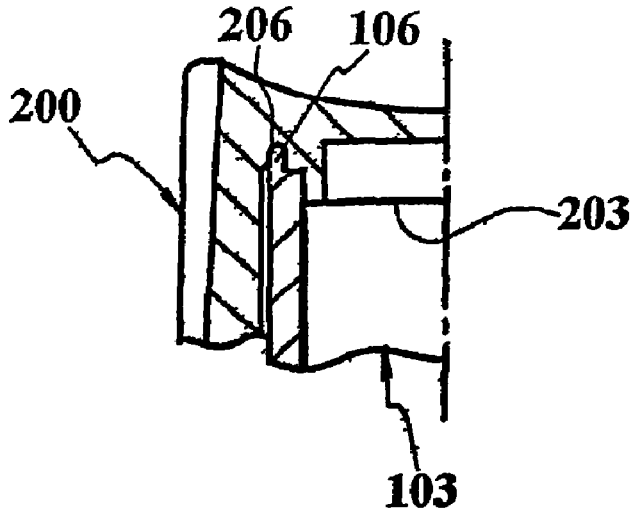

Referring to FIGS. 8 and 9, the male seal projection 106 is defined by a circumferential step formed on an upper end of the spouting portion 103. In use, the insertion groove 206 of the closer 200 is associated with the circumferential step 106, thereby providing a tight seal.

Figure 10:
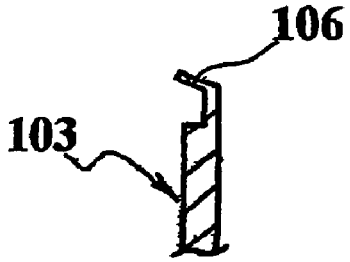
Figure 11:
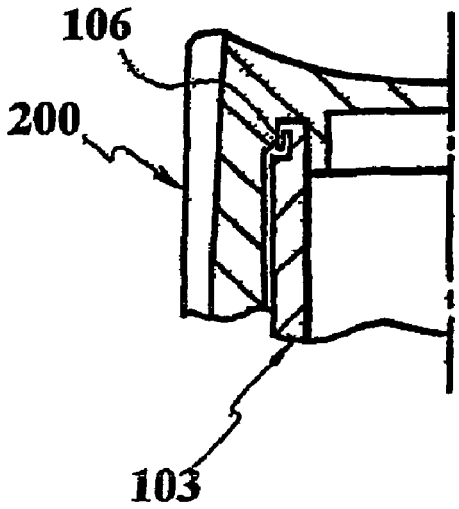

Referring to FIGS. 10 and 11, the circumferential step 106 is designed to be foldable outward. In use, an upper end of the circumferential step 106 is folded by the insertion groove of the closer 200 to provide an enhanced tight seal.

Figure 12:
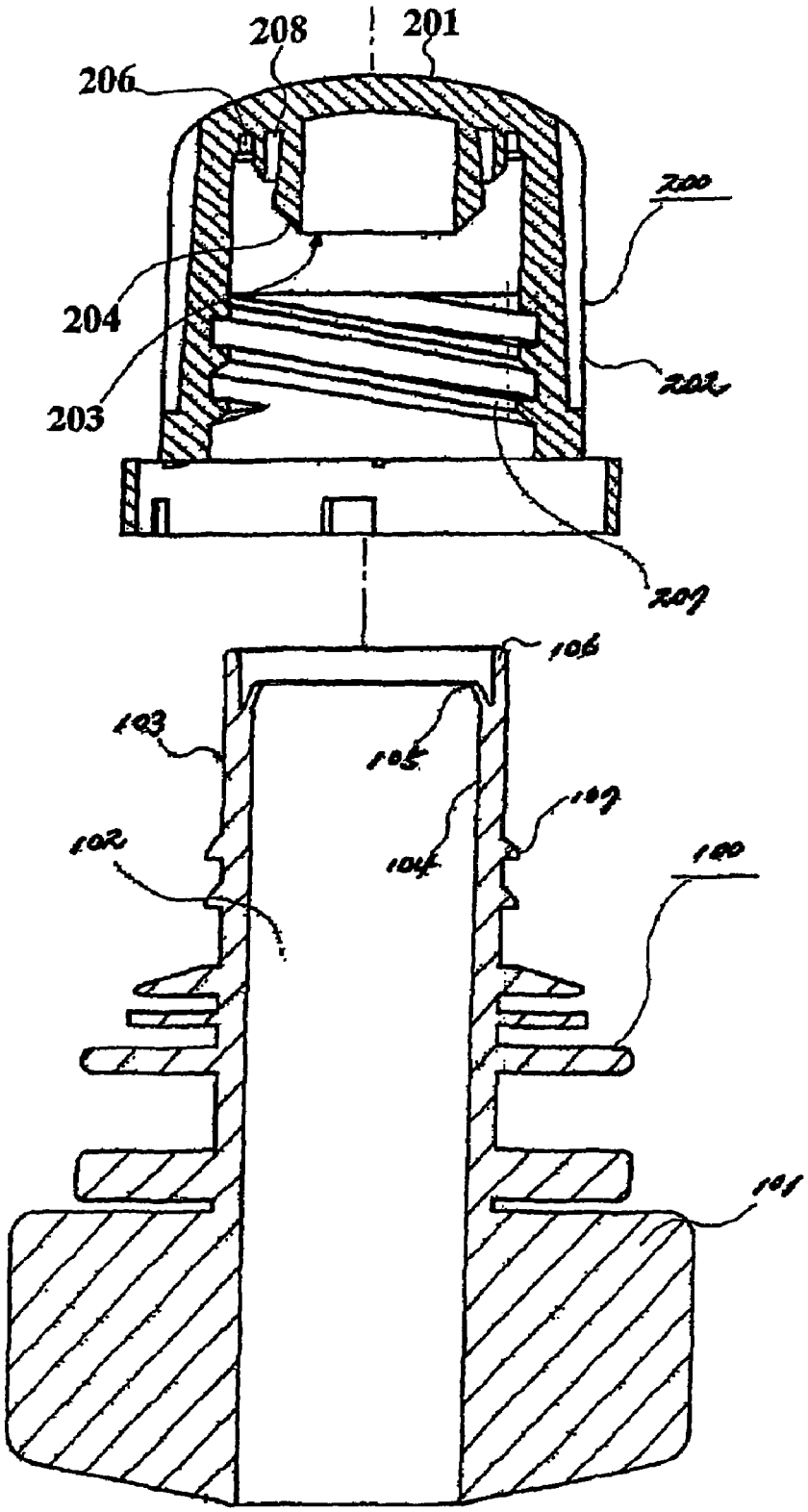

FIG. 12 shows a modified example of a female seal structure of the present invention.

As shown in the drawings, the spouting member 100 comprises the circumferential elastic projection 105 inclined at a predetermined angle from the inner wall 104 as the male seal structure and the male seal projection 106 formed on the upper end of the spouting portion 103.

The closer 200 corresponding to the spouting member 100 comprises an inner closer 203 provided at a lower end with an inclined wall 204. A sub-insertion groove 208 is formed on the bottom of the top portion of the closer 200 above the inclined wall 204. The circumferential elastic projection 105 is inserted in the sub-insertion groove 208. In addition, an insertion groove 206 in which the male seal projection 106 is inserted is further formed on the bottom of the top portion of the closer 200.

Figure 13:
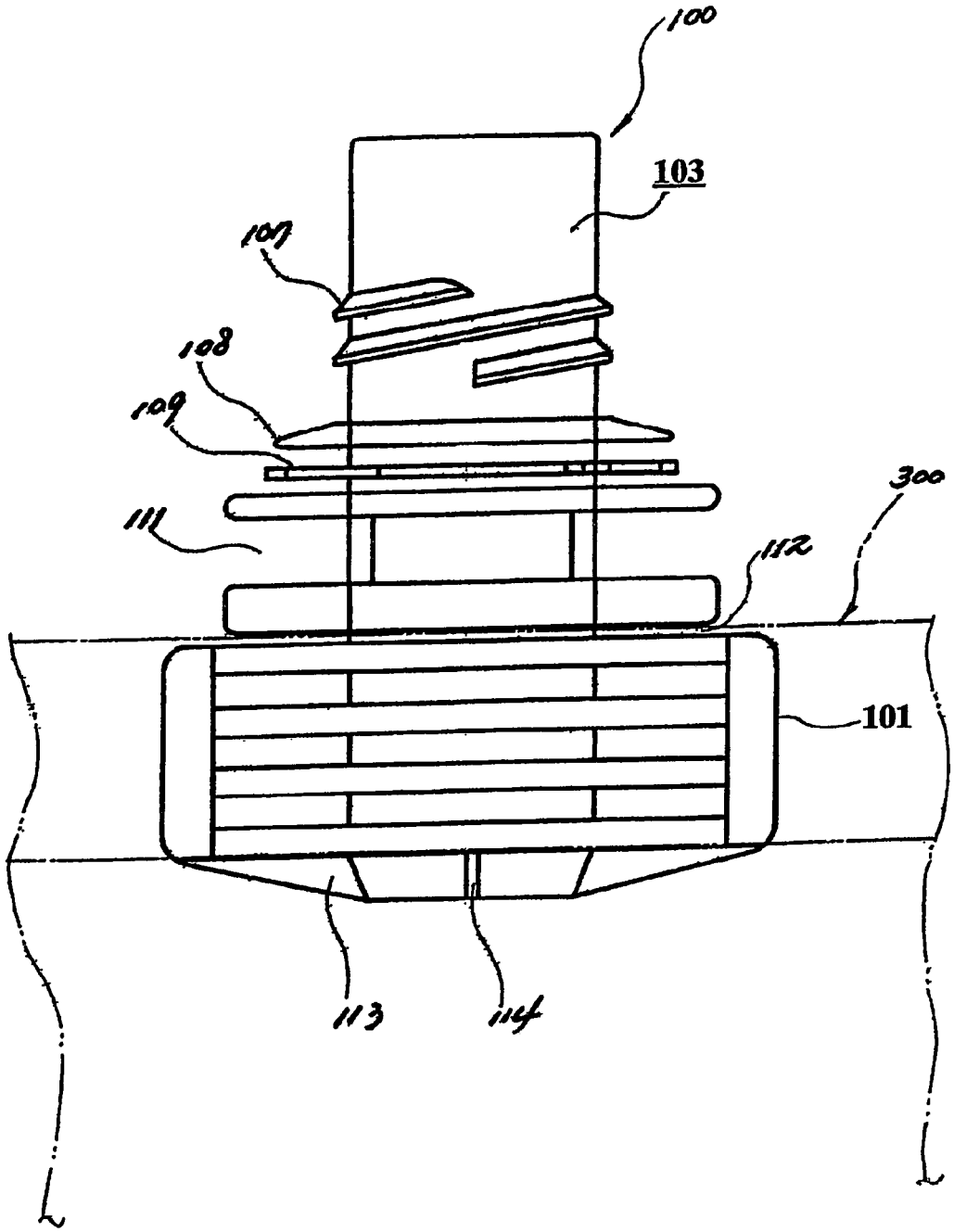
FIG. 13 is a side view of a spout assembly of the present invention that is attached on a container body.

FIG. 13 shows a detailed view of the spouting member.

As shown in the drawing, formed between the spouting portion 103 and the attaching portion 101 are a tamper-proof fixing portion 108 and a hook projection forming portion 109. First and second spaces 111 and 112 are defined between the attaching portion and the hook projection forming portion 109 by circumferential projections.

Guiding members 113 and 114 for guiding the insertion of the attaching portion 101 on the container body 300 are formed extending downward from the attaching portion 101.

Films of the container body 300 are attached with the attaching portion 101 through a thermal-bonding process. In the course of the thermal-bonding process, the films and the attaching portion 101 are partly molten. At this point, the molten material flows into the second space 112 to prevent the outer appearance of the container from being deteriorated.

Figure 14:
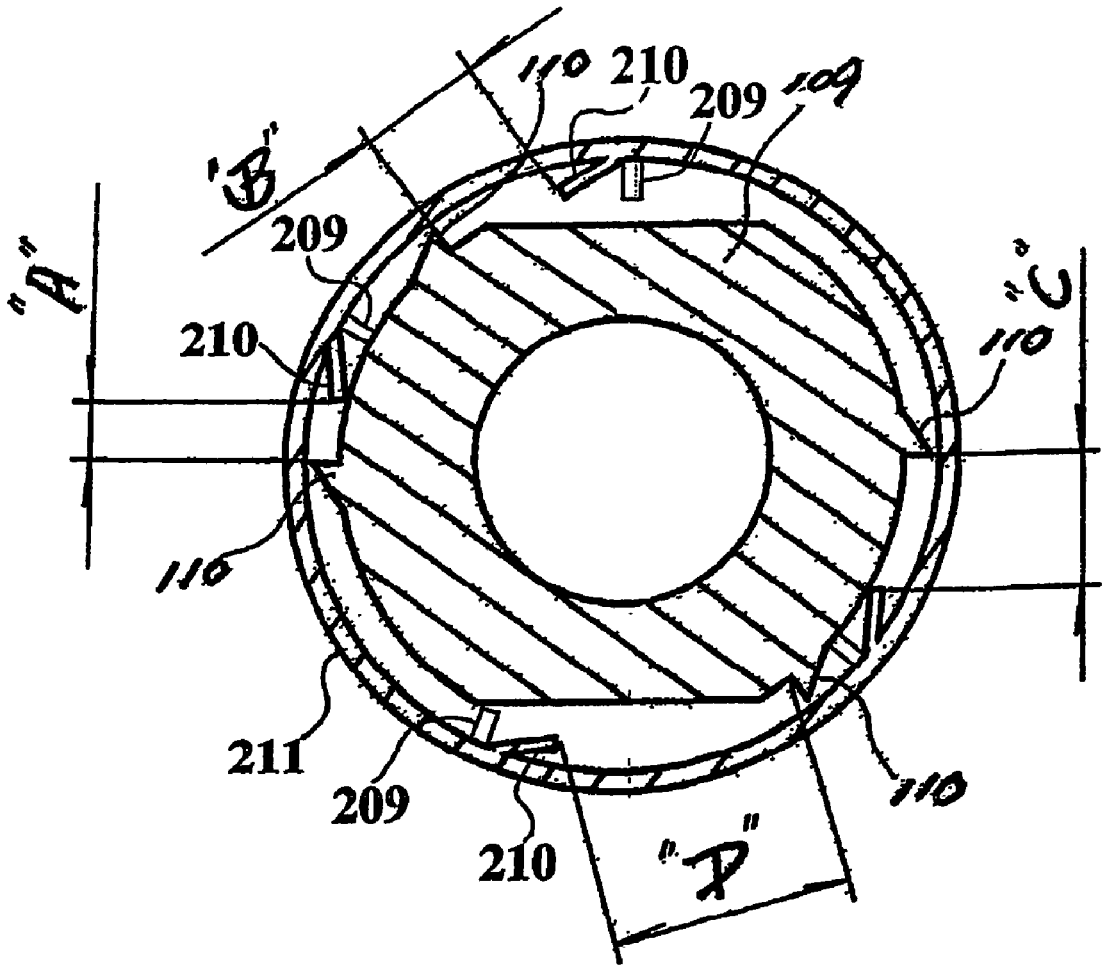
FIGS. 14 to 17 are sectional views of a tamper-proof part of a spout assembly according to the present invention.

FIG. 14 shows a structure in relation with the hook projection forming portion.

The hook projection forming portion 109 is provided with a plurality of hook projections 110. The tamper-proof 211 of the closer 200 is provided with a plurality of elastic projections 210 that are designed to be hooked by the hook projections 110 to break away connecting portions 209 of the tamper-proof 211 from the closer 200. When the closer 200 is coupled on the spouting member 100, the distances A, B, C and D between the hook projections 110 and the elastic projections 210 are designed to be different from each other. When opening the closer 200, the connecting portion having the smallest distance A is first broken and the connecting portion having the largest distance D is lastly broken.

The distances A, B, C and D can be designed to be reduced gradually or randomly. Instead of the connecting portions 209, a cutting line may be formed between the tamper-proof 211 and the closer 200, so that the tamper-proof 211 can be broken away as the elastic projections 210 are hooked on the hook projections 110.

Figure 15:
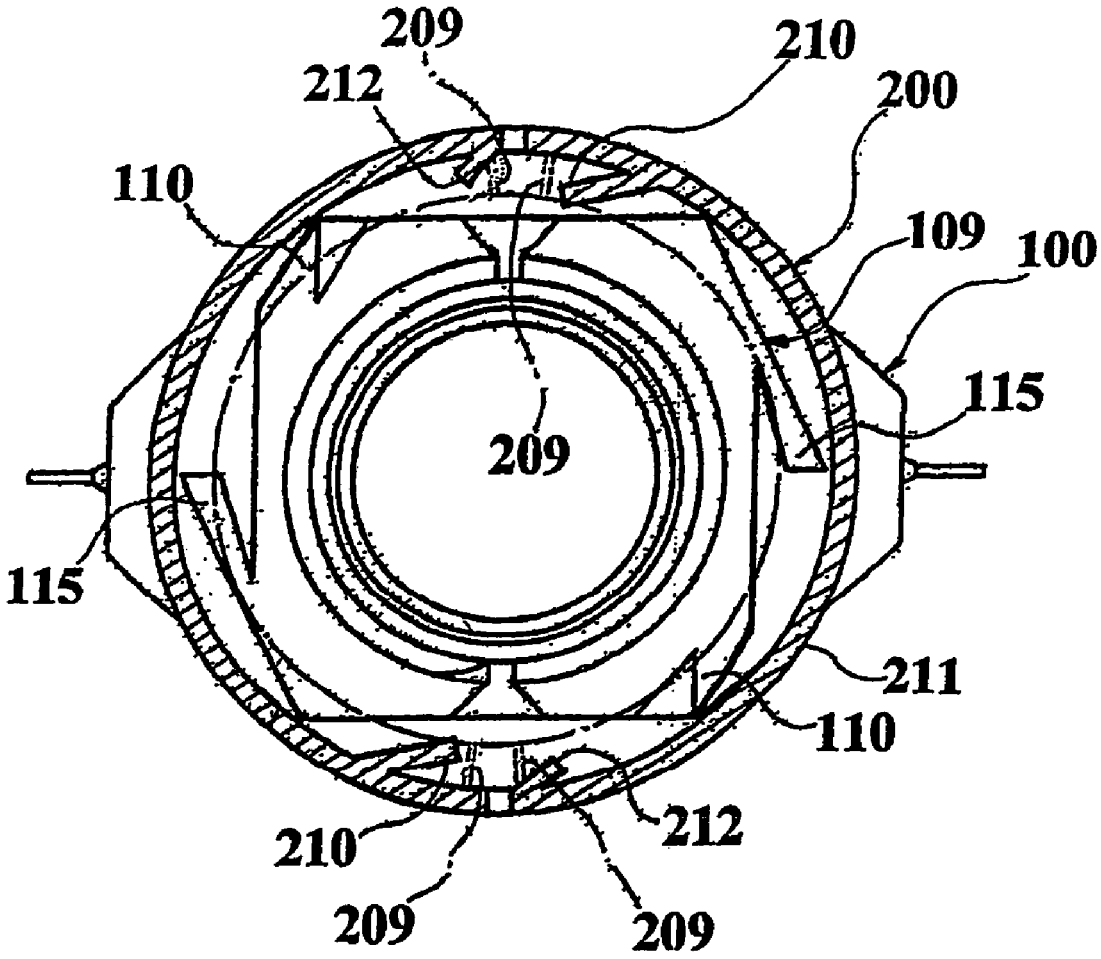

FIG. 15 shows a modified example of the hook projection forming portion 109 and the tamper-proof 211.

As shown in the drawing, the spouting member 100 is provided below the spouting portion with a plurality of hook projections 110 and the elastic hook projections 115 where the tamper-proof 211 can be hooked and fixed.

The tamper-proof 211 is provided with a plurality of elastic projections 210 that are hooked on the hook projections 110 or the elastic hook projections 115. The tamper-proof 211 is further provided with connecting portions 209 formed near the elastic projections 210. The tamper-proof 211 is further provided with resisting projections formed near the connecting portions 209.

Figure 16:
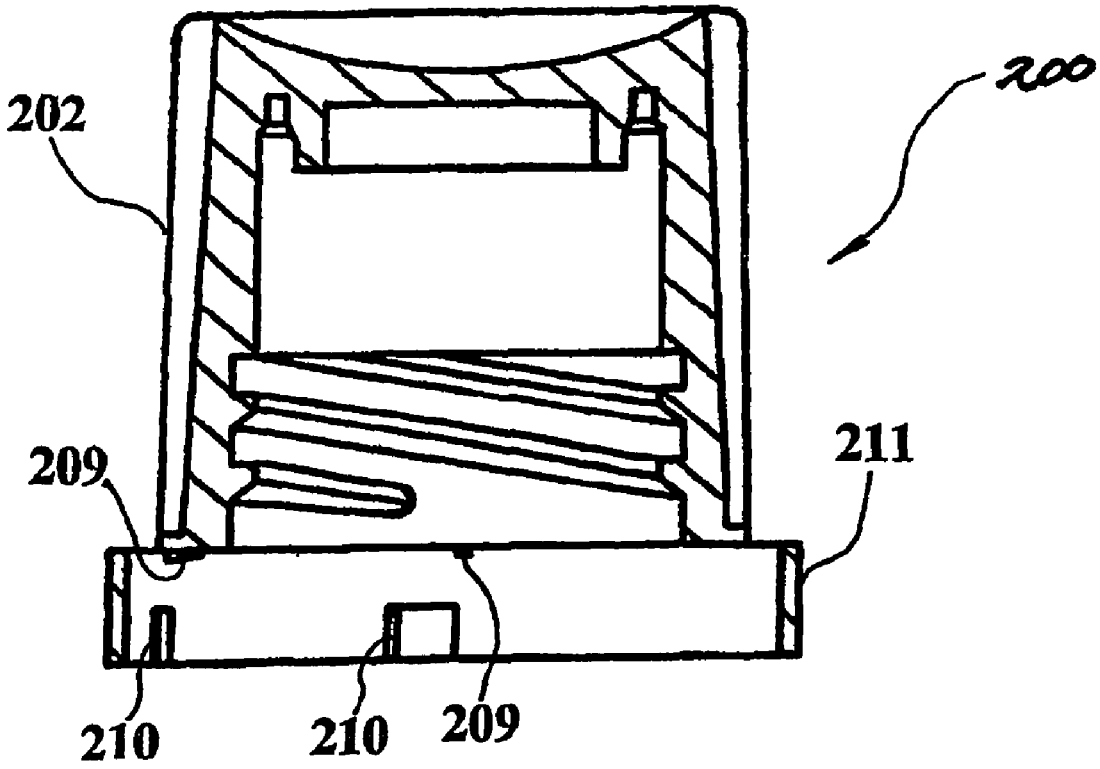
Figure 17:
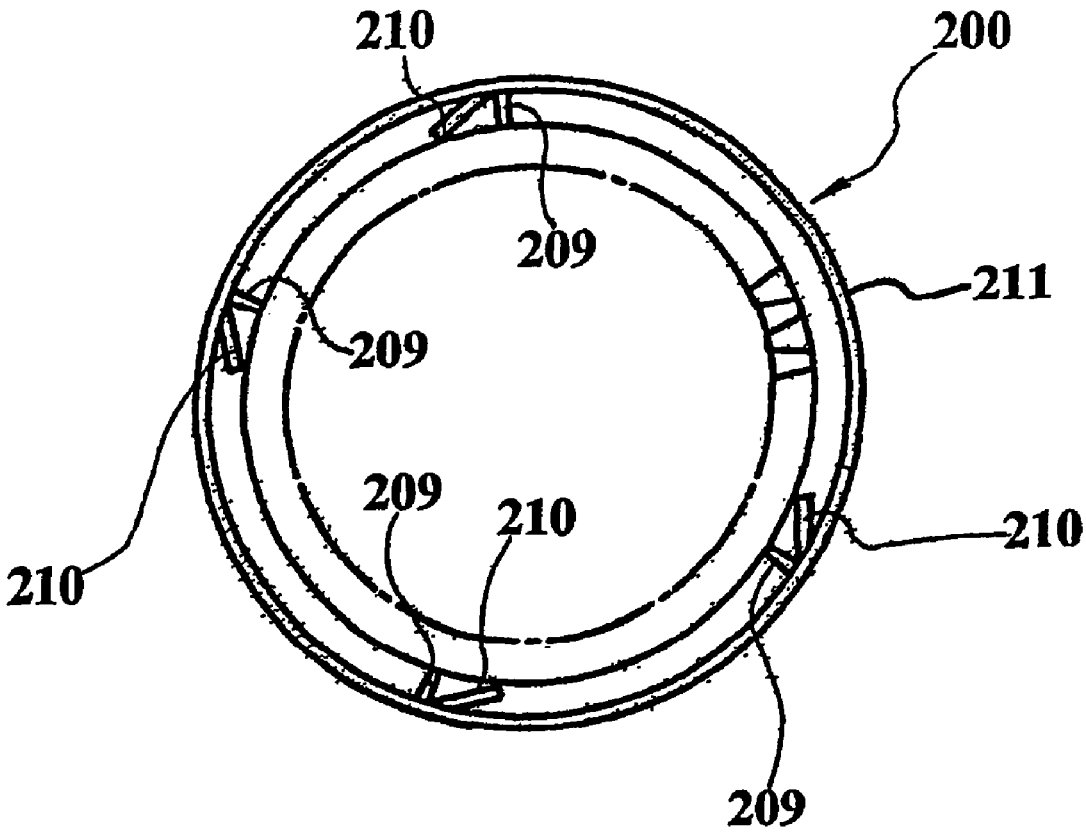

FIGS. 16 and 17 show a closer 200. The closer 200 having a tamper-proof 211 connected to a lower end of the side portion 202 by the connecting portions 209. The elastic projections 210 are formed on the inner wall of the tamper-proof 211 and inclined in a predetermined direction.

Figure 18:
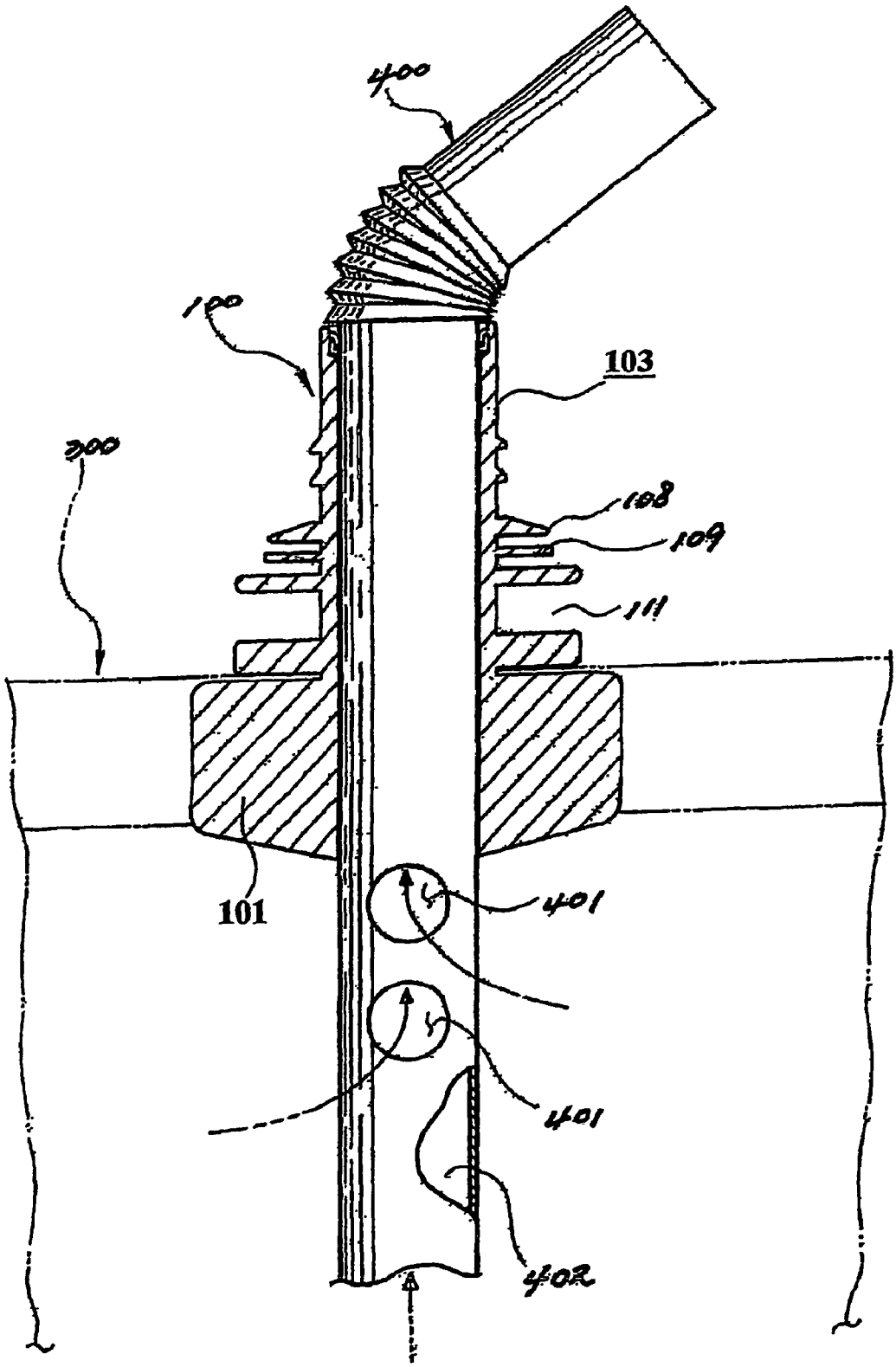
FIG. 18 is a sectional view of a structure for receiving a straw in a spout assembly of the present invention.

FIG. 18 shows a spout assembly associated with a straw.

As shown in the drawing, a straw 400 is inserted through the spouting portion 103 of the spouting member. A tight seal is formed between the spouting portion 103 and the straw 400.

In use, when pressing or squeezing the container, the content in the container is exhausted through the spouting hole 402 or a side bypass hole 401. The user may suck the straw to drink the content.

INDUSTRIAL APPLICABILITY

As described above, since the spout assembly for a liquid container according to the present invention is designed to allow liquid material contained in the container to be preserved for a long time by improving a seal state that is realized by a female seal structure that is designed to be engaged with a male seal structure formed on a spouting portion of the container, it can be applied to a variety of container for container liquid materials such as beverages or industrial liquid agents.

The invention claimed is:

1. A spout assembly for a liquid container, comprising:

a spouting member formed on an outlet of the container;

a closer coupled on the spouting member having a spouting groove formed therein adapted to receive the spouting member;

a male seal structure formed on the spouting member comprising a male seal projection extending, having a thickness which is less than a thickness of the spouting member from an outer circumference of the spouting member and an elastic seal projection extending from an inner circumference of the spouting member and adjacent the male seal projection; and a female seal structure formed on the closer, the female seal structure corresponding to the male seal structure and comprising an insertion groove extending from and parallel with the spouting groove and having a width which is less than a width of the spouting groove configured to receive the male seal projection from the spouting member and a lower end outer circumferential surface and circumferential seal wall configured adjacent the insertion groove to abut the elastic seal projection of the spouting member thereby sealing the liquid container.

2. The spout assembly of claim 1 wherein the elastic seal projection is inclined outward or inward, and the female seal structure comprises a seal wall tightly depressing the circumferential elastic seal projection.

3. The spout assembly of claim 1 wherein the female seal structure comprises a circumferential inclined wall for guiding the circumferential elastic seal projection.

4. The spout assembly of claim 1 further comprising a tamper-proof connected to the closer, the tamper-proof being provided with elastic projections and the spouting member being provided with hook projections, at least couple of distances between the elastic projections and the hook projections are different from each other so that the elastic projections can contact the hook projection with time differences when opening the closer.

5. The spout assembly of claim 4 wherein the tamper-proof is further provided with resistance projections and the spouting member is provided with elastic hook projections.

6. The spout assembly of claim 1 wherein a space is defined above an attaching portion of the spouting member, the attaching portion is attached on the inlet of the container.

7. The spout assembly of claim 1 wherein a straw is inserted in the spouting portion of the spouting member.

8. The spout assembly of claim 1 wherein the spouting member comprises a spouting guide member extending downward from an attaching portion that is attached on the inlet of the container.

9. The spout assembly of claim 1 wherein the spouting member is integrally formed with the container.

10. The spouting assembly of claim 1 wherein the spouting member is attached on the inlet of the container.

11. The spouting assembly of claim 1 wherein the container is formed of a paper pack or a film pouch.

12. The spout assembly of claim 1 wherein the male seal structure comprises the elastic seal projection formed on an upper end of a spouting portion or an inner wall defining the spouting portion.

* * * * *